United States Patent [19]

Michlin et al.

[11] Patent Number: 5,030,997

[45] Date of Patent: Jul. 9, 1991

[54] TONER DISPENSER FOR XEROGRAPHIC MACHINES

[75] Inventors: Norman Michlin, Dearborn; Michael A. Wawsczyk, Mt. Clemens, both of Mich.

[73] Assignee: Universal Developer and Manufacturing Co., Dearborn, Mich.

[21] Appl. No.: 491,503

[22] Filed: Mar. 12, 1990

Related U.S. Application Data

[63] Continuation-in-part of Ser. No. 225,466, Jul. 26, 1988, abandoned.

[51] Int. Cl.[5] ..... G03G 15/06

[52] U.S. Cl. ..... 355/260; 118/653; 222/DIG. 1

[58] Field of Search ..... 355/260, 298; 118/653; 222/DIG. 1, 169-172, 325; 206/219; 366/187, 220

[56] References Cited

U.S. PATENT DOCUMENTS

| | | | |
|---|---|---|---|
| 4,091,765 | 5/1978 | Lowthorp et al. | 118/658 |
| 4,456,364 | 6/1984 | Hatzis | 355/260 |
| 4,528,936 | 7/1985 | Shimazaki et al. | 118/653 |
| 4,688,926 | 8/1987 | Manno | 355/260 |
| 4,696,418 | 9/1987 | Kurotaka et al. | 222/DIG. 1 |
| 4,740,808 | 4/1988 | Kasamura et al. | 355/260 |
| 4,832,233 | 5/1989 | Ichihara et al. | 118/653 X |

FOREIGN PATENT DOCUMENTS 0221770 10/1986 Japan .

*Primary Examiner*—A. T. Grimley
*Assistant Examiner*—Robert Beatty
*Attorney, Agent, or Firm*—Krass & Young

[57] ABSTRACT

A toner supply and dispensing cartridge for use with a xerographic copying machine. The cartridge includes a cylinder which contains a supply of particulate toner material, the cylinder having a plurality of toner dispensing ports formed along the longitudinal axis of the cylinder. The cylinder is supported for rotation at both ends and includes a freely riding multi-cup scoop extending the length of the cylinder and disposed inside for dispensing the toner material, said scoop preferably having an approximately cross-shaped cross-section. Preferably, at least part of the cartridge is formed of a transparent or translucent material so that the level of toner material remaining inside may be easily determined.

13 Claims, 3 Drawing Sheets

FIG. 1
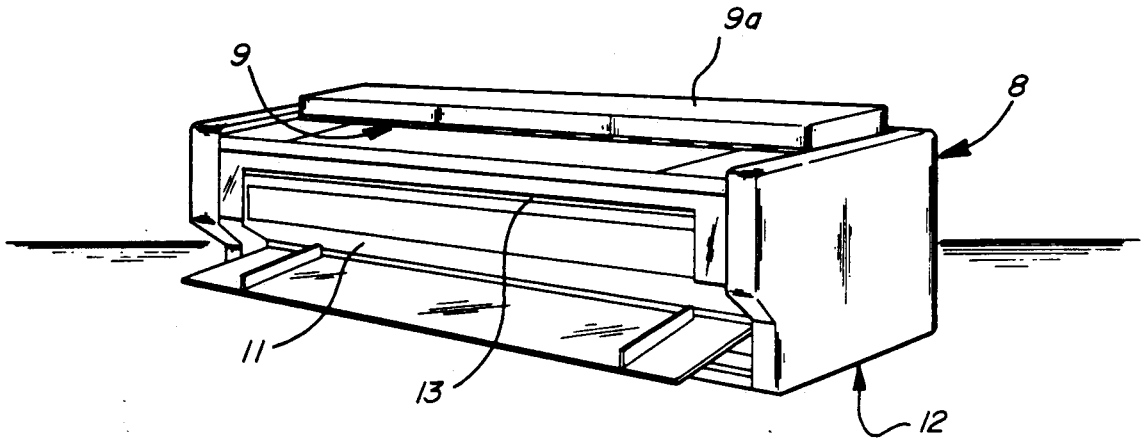
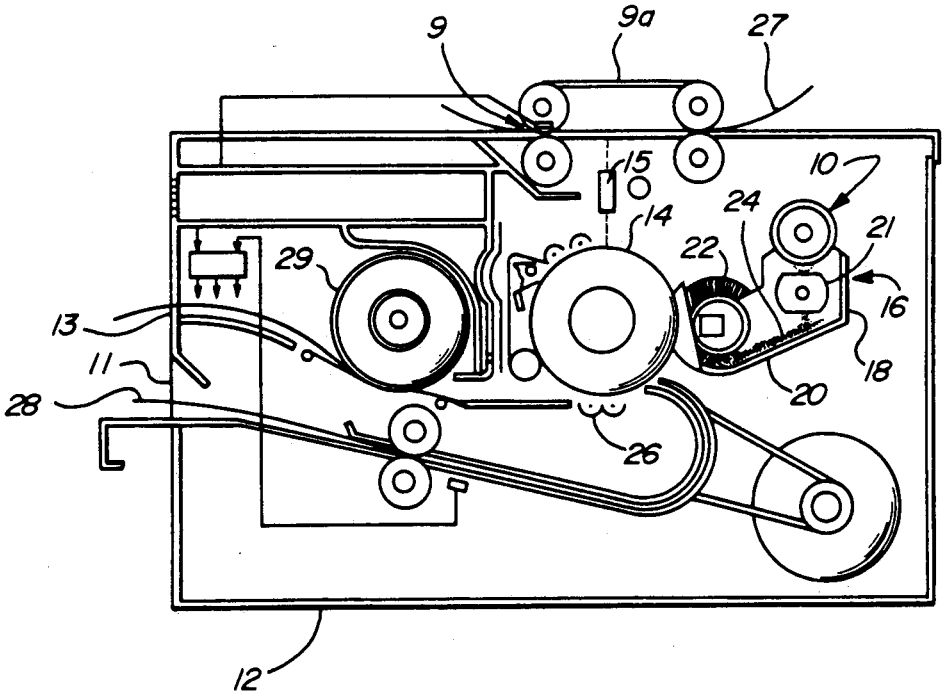
FIG. 2

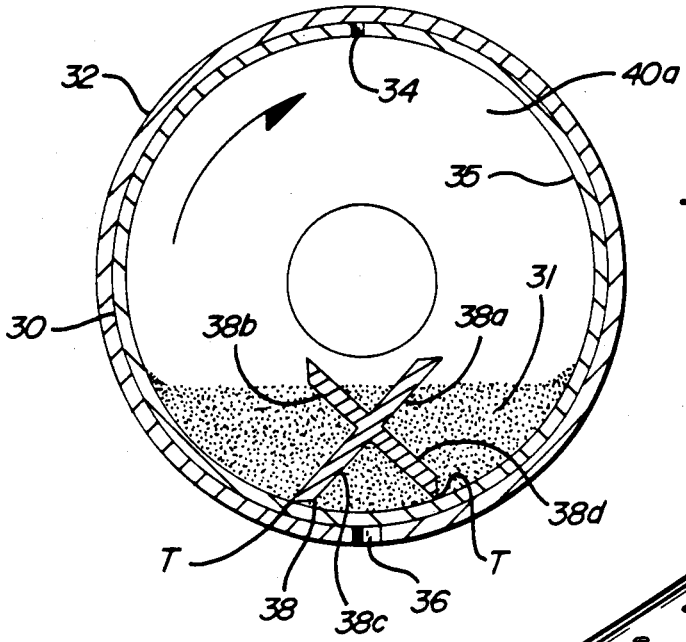
FIG - 6
FIG - 3
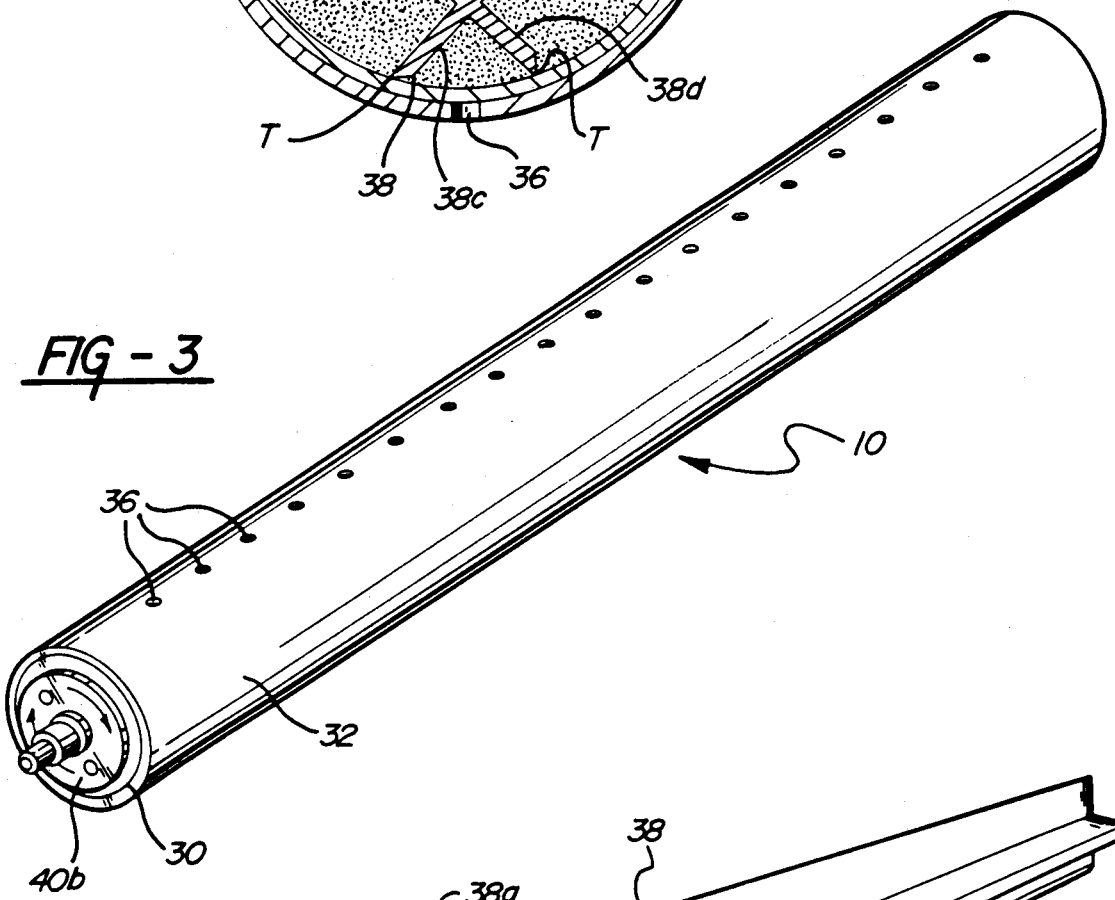
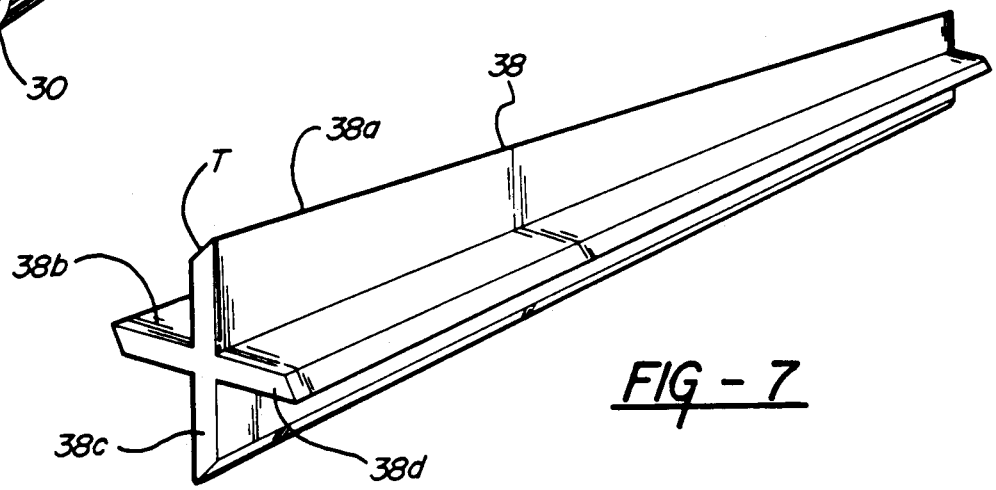
FIG - 7

TONER DISPENSER FOR XEROGRAPHIC MACHINES

DESCRIPTION OF RELATED APPLICATION

This application is a continuation-in-part of Ser. No. 225,466, filed July 26, 1988, now abandoned.

BACKGROUND OF THE INVENTION

1. Field of the Invention

This invention relates to xerographic machines, and more particularly, to a cartridge for supplying and distributing magnetically responsive dry particulate toner material to such a machine.

2. Description of the Relevant Prior Art

In the process of xerography, a latent electrostatic image of an original is generated on a movable surface having a photoconductive material on a conductive backing which first is given a uniform electric charge over its surface, said latent image being generated by exposing the surface to the original by conventional projection techniques. Following exposure, the latent electrostatic images on the moving surface are developed at a developing station which, typically, includes one or more magnetic brushes for bringing a developer comprised of a mixture of carrier beads and toner into developing relation with the movable surface and the latent image formed thereon. The developed image is then transferred at a transfer station to a copy substrate material such as a sheet of copy paper. The toner particles, which are many times smaller than the carrier beads, adhere to and coat the surface of the carrier particles due to the electrostatic attraction therebetween. As the toner-coated carrier beads roll or tumble over the movable surface carrying the latent electrostatic image of opposite polarity to the charge on the toner, toner particles are pulled away from the carrier beads by the latent electrostatic image and deposited on the movable surface to form a developed toner image. After transfer of the image, leftover developer is removed from the movable surface, while the developed image previously transferred to the copy substrate material is fixed, as by fusing, to form a permanent copy.

As toner powder images are formed, additional toner material must be supplied to the developer mixture to replenish the toner deposited on the movable surface. Various types of toner resupply systems have been described in the prior art in, for example, U.S. Pat. Nos. 3,337,072 to Del Vecchio et al. and 4,091,765 to Lowthorp, deceased, et al. In the Del Vecchio patent, the toner container includes a hollow cylindrical sleeve having an opening in its peripheral surface through which toner material is discharged. A substantially cylindrical core having a closure portion is rotatably mounted inside the sleeve to form a closure of the sleeve opening to retain the contents therein. As the core is rotated within the sleeve, the closure portion is moved into or out of interference with the sleeve opening. Lowthorp discloses a disposable toner cartridge assembly which includes an inner tube rotatably carried in an outer tube, both of which are provided with an elongate dispensing slot extending parallel to the cartridge axis so that the slots can be placed in alignment with each other as the outer tube is rotated about the inner tube. As the slots come into alignment, toner material inside the inner sleeve is dispensed therethrough.

Another system is disclosed in U.S. Pat. No. 4,688,926 to Manno. Manno discloses a toner supply cartridge and dispensing system including a tube-like cylinder which contains a supply of fresh toner which is supported in spaced relation above a toner sump which forms part of a developer housing inside a conventional xerographic machine. Drive means are provided for rotating the cylinder. Formed in the cylinder are a plurality of differently sized toner discharge openings extending in a row along the longitudinal axis of the cylinder for the toner to pass from the cylinder into the developer housing. The plurality of toner discharge openings are sized differently from one another to regulate the quantity of toner discharged in accordance with various machine operating conditions. Control means are provided for discharging controlled amounts of fresh toner through the toner discharge openings in timed synchronization with the rotation of the cylinder. Toner is discharged when the toner discharge openings are facing the developer housing and fall by gravity into the toner sump.

Various control means for controlling the amount of toner discharged are discussed in Manno. In one embodiment, the control means includes a strip-like closure in sealing engagement with the periphery of the cylinder opposite the row of toner discharge openings. The strip has apertures formed therein corresponding to each toner discharge opening and is supported for reciprocal sliding movement on the cylinder so that the apertures in the strip periodically come into alignment with the toner discharge openings to permit the discharge of toner. Alternatively, the control means may comprise a rotatable rod which is in sealing engagement with the periphery of the cylinder opposite the row of toner discharge openings. Portions of the circumference of the rod opposite each of said toner discharge openings are removed to form a row of flats. As the rod is rotated, the flats pick up a portion of toner through the toner discharge openings and rotate to discharge the toner into the developer housing.

The systems disclosed in U.S. Pat. No. 4,688,926 are complicated from a mechanical standpoint and contain several moving parts. Hence, these toner cartridges are somewhat expensive to manufacture and careful quality control is necessary to minimize product failure. Such qualities are inherently undesirable in a product such as a toner supply cartridge which is intended to be periodically replaced when the supply of toner in the old cartridge becomes exhausted. Moreover, none of the patents discussed make any provision for the operator's ability to monitor the supply of toner remaining within the cartridge. Since the user has no way to determine how much toner remains, it is possible that the operator will be unprepared in the event of exhaustion and may not have a replacement cartridge on hand.

It would be desirable to provide a cartridge for supplying and distributing particulate toner material in a xerographic machine wherein the supply of toner material remaining within the cartridge may be easily monitored by the operator, thus ensuring timely procurement of a replacement cartridge.

It would be highly desirable to provide such a cartridge which is mechanically simple in operation, does not require close manufacturing tolerances, and is relatively inexpensive to manufacture.

It would also be desirable to provide such a cartridge which may be adapted for insertion in a wide variety of existing xerographic copying machines.

SUMMARY OF THE INVENTION

Disclosed and claimed herein is a cartridge for supplying and distributing magnetically responsive dry particulate toner material to a latent electrostatic image formed on a movable surface such as a copier drum for subsequent transfer to a copy substrate such as typical copying paper. The cartridge comprises a hollow cylinder which is adapted to contain a supply of particulate toner material. The cylinder is supported for rotation at both ends within the housing of a xerographic machine such that toner material discharged from the cylinder may be transferred to the latent image formed on the copy substrate. Drive means are provided for rotating the cylinder in timed relation to the drum of the copying machine. A plurality of toner discharge ports are formed in the cylinder and disposed at intervals along a longitudinal axis thereof. A freely riding multi-cup scoop is disposed inside the cylinder; the scoop extends for substantially the length of the cylinder. In a preferred embodiment, it is configured to be approximately cross-shaped in a section taken transverse the axis of elongation. In another preferred embodiment, each arm of the cross is tapered to form a cup shape. As the cylinder rotates, the cups of the scoop will gather and sweep up toner material and push it out of cylinder ports. The tapering configuration of the cups allows them to scrape the toner material from the inside wall of the cartridge, thus further assisting in the discharge of toner.

Due to the presence of the freely riding multi-cup scoop, it has been found that the toner discharge ports will, preferably, have a diameter of approximately 0.056 inches. Although the ports disclosed in the Manno patent are much larger (approximately 0.25 inches), the scraping action of the cups of the scoop against the surface of the cylinder tends to squeeze toner material out through the toner discharge ports in the cartridge of the instant invention. Hence, the ports can be made much smaller, therefore minimizing the possibility of leakage of toner material from the cartridge.

In order to provide for easy monitoring of the toner supply level within the cartridge, it is desirable that at least part of the cartridge be formed of an at least partially transparent material. Typically, one or more transparent or translucent end caps will be disposed at each end of the cartridge to provide for easy monitoring. These transparent or translucent end caps may take a variety of configurations depending upon the requirements of the particular xerographic machine in which the cartridge is to be installed. Alternatively, the end caps may be opaque and a transparent or translucent window be disposed on the surface of the cylinder.

The toner supply cartridge disclosed herein may further comprise a stationary sleeve disposed around the rotating cylinder. The sleeve has a plurality of openings formed therein at locations thereon corresponding to the locations of the toner discharge ports. Hence, as the cylinder rotates, the ports formed therein will periodically come into alignment with the openings formed in the sleeve to permit the discharge of toner material therethrough. Typically, the openings in the sleeve will be substantially larger in diameter than the toner discharge ports.

BRIEF DESCRIPTION OF THE DRAWINGS

The claims may best be understood by reference to the following detailed description and drawings in which:

FIG. 1 is a perspective view of a typical xerographic copying machine in which the toner cartridge of the instant invention may be used;

FIG. 2 is a simplified sectional side view of the typical xerographic copying machine of FIG. 1 showing the relationship of the various parts thereof;

FIG. 3 is a perspective view of a cartridge for supplying and distributing particulate toner material according to the principles of the instant invention;

FIG. 6 is an inside cross-sectional view of the toner cartridge of FIG. 3 showing a transparent end cap; and FIG. 7 is a perspective view of a multi-cup scoop designed according to the principles of the instant invention.

DETAILED DESCRIPTION OF THE PREFERRED EMBODIMENT

Figure 4:
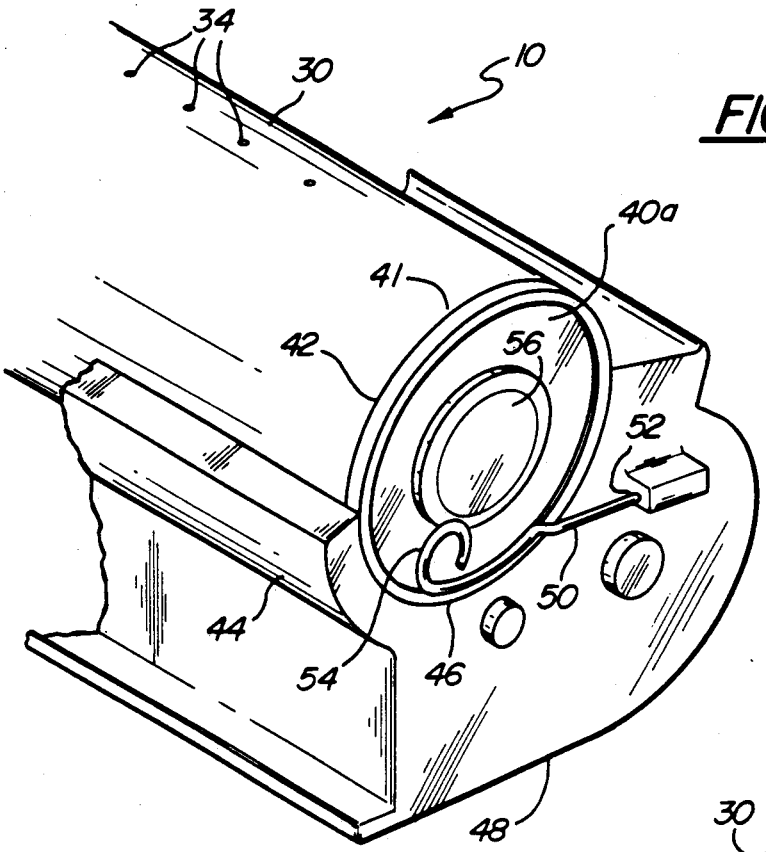
FIG. 4 is a perspective view of the end cap and support for one end of a toner cartridge of the instant invention.

In the following detailed description, like reference numerals are used to refer to the same element of the herein invention shown in multiple figures thereof.

Referring to the drawing and in particular to FIGS. 1 and 2, there is shown a xerographic copying machine 8 utilizing a toner supply cartridge 10 of the instant invention. Xerographic machine 8 has a housing 12 for supporting and housing the various components thereof. As may be seen in FIG. 1, the original of which it is desired to make one or more copies is fed into feeder 9. In various designs of xerographic machines, the original may be automatically fed, or it may be necessary to lift a cover portion 9*a* to place the original into the machine 8. Copy paper 28 is fed through paper supply slot 13 into the interior of housing 12 and, after a copy of the original is formed thereon, is ejected through ejection slot 11.

The basic construction and operation of xerographic machine 8 is familiar to those skilled in the art. The following description is a synopsis of that contained in the above-referenced U.S. Pat. No. 4,688,926 (the disclosure of which is herein incorporated by reference), and is intended for illustrative purposes only. The toner supply cartridge of the instant invention is intended for use with xerographic copying machines of a wide variety of designs and its use is not limited solely to the particular xerographic machine 8 described herein. In xerographic machine 8 as depicted in FIG. 2, a movable recording member 14 is provided in the form of a rotating drum. However, other movable recording members are contemplated by the instant invention, such as belts, webs, glass plates, etc. A uniform charge is put on movable recording member 14. The charged recording member 14 is exposed to the image of the original, the image being focused on movable recording member 14 by means of lens 15. Developing means 16 includes developer housing 18 which is configured at its lower end to form developer sump 20. Toner supply cartridge 10 is disposed in developer housing 18 in operative relation to magnetic brush 22 which operates as a transfer means for transferring developer 24 to the charged surface of movable recording means 14 upon which the latent electrostatic image of the original has been formed. Developer 24 is comprised of particulate toner material dispensed from toner supply cartridge 10 which is mixed in suitable proportions with carrier beads by means of mixing station 21. Magnetic brush 22 attracts the developer material 24 and transfers it to movable recording member 14 to which it adheres due to electrostatic attraction. Excess developer is scraped away from movable recording member 14 and returned to developer sump 20 for subsequent admixture with fresh toner material in mixing station 21. The now developed image on movable recording member 14 is transferred to copy substrate 28 by means of transfer corotrons 26. The transferred image of the original is then permanently fixed on copy substrate 28 by means of heated roller 29. The now completed copy of the original is then discharged through discharge slot 11. Obviously, a xerographic machine of the type described herein contains many additional components which serve to, for example, guide the copy substrate 28 through the various steps of the copying process, actuate the various rollers and drums, synchronize operation of the various mechanical components, etc. However, these details are well-known in the prior art and do not constitute part of the inventive concept of the toner supply cartridge disclosed and claimed herein.

Referring now to FIGS. 3–7, there is depicted in greater detail the toner supply cartridge of the instant invention. The toner supply cartridge 10 includes a cylinder 30 which is adapted to contain a supply of particulate toner material 31. Formed at intervals along the longitudinal axis of cylinder 30 are toner supply ports 34 which have an approximate diameter of 0.056 inches. A multi-cup scoop 38, as shown in FIGS. 6 and 7, is disposed inside cylinder 30. It has been found that good dispensing of particulate toner material 31 may be obtained if multi-cup scoop 38 is configured in the shape of a cross having four arms 38*a*, 38*b*, 38*c*, 38*d*, each such arm having a portion cut away to form a tapering tip T. However, scoop 38 could have fewer or more arms. Scoop 38 preferably has a cross-sectional diameter of approximately 1¼ to 1⅜ inch, approximately half of the inside diameter of cylinder 30. Preferably, the approximate length of scoop 38 will be slightly less than the length of cylinder 30 in which it is disposed. The length of cylinder 30 will vary depending on the range of copy sizes which may be made on any particular xerographic machine. In the xerographic machine 8 depicted in FIGS. 1 and 2, which is designed to accomplish unreduced copying of originals ranging up to blueprint size, the length of cylinder 30 may be as much as 37 or 38 inches. However, for other types of xerographic machines designed to make letter or legal sized copies, the length of cylinder 30 and four-cup scoop 38 would obviously be much less.

Cylinder 30 is mounted for rotation inside developer housing 18. To that end, cylinder 30 is provided with two end caps 40*a* and 40*b* which are adapted to support cylinder 30 for rotation about a central axis. The configuration of end cap 40*a* is depicted in greater detail in FIG. 4. End cap 40*a* is designed to fit flush against end 41 of cylinder 30. Formed on the perimeter of end cap 40*a* is a raised rim 42. A tube end journal 44 with concave interior bearing surface 46 against which rim 42 rides is provided on side 48 of developer housing 18. To retain end cap 40*a* in positive engagement with bearing surface 46, a biased retaining spring 50 is provided. Retaining spring 50 has one end 52 secured to side 48 of housing 18. The opposite end 54 is configured to be substantially circular and offset inwardly such that end 54 rides against the recessed surface of rim 42 of end cap 40*a*. End cap 40*a* may optionally be formed with a removable plug 56 to permit refill of cylinder 30 with fresh particulate toner material 31 when the supply thereof is depleted. Alternately, plug 56 may be formed integral with end cap 40*a*, in which case the toner supply cartridge 10 will not be refillable. However, it is contemplated that the relative low cost of the toner supply cartridge of the instant invention may create a consumer preference for simply disposing of the empty cartridge, rather than attempting the tedious and messy procedure of refilling the cylinder 30.

The opposite end 61 of cylinder 30 is provided with end cap 40*b* which also fits flush thereagainst. Projecting from end cap 40*b* is a shaft 60 which is adapted to be rotatably supported by end 49 of developer housing 48 in the manner depicted in FIG. 5. Cylinder 30 is rotated in predetermined timed relation with magnetic brush 24 and shaft 21*a* of mixing chamber 21 by cam 62 and cam follower 64 respectively. Cam 64 is drivingly coupled to and rotates with shaft 21*a* of mixing chamber 21. Cam follower 64 is drivingly coupled to shaft 24*a* of magnetic brush 24. In this manner, cylinder 30 is rotatingly driven in the direction shown in FIGS. 3 and 6.

Optionally, as shown in FIG. 3, a stationary sleeve 32 may be disposed around rotatable cylinder 30. Stationary sleeve 32 has formed thereon at locations corresponding to the locations of toner discharge ports 34 formed in cylinder 32 a plurality of openings 36. As cylinder 30 rotates, toner discharge ports 34 will periodically align with openings 36, thereby permitting the discharge of particulate toner material 31 therethrough. It has been found through experimentation that, to permit the discharge of correct amounts of particulate toner material 31, it is necessary to make the diameters of openings 36 considerably larger than those of toner discharge ports 34. Preferably, the diameters of openings 36 will be approximately 0.25 inches.

Figure 5:
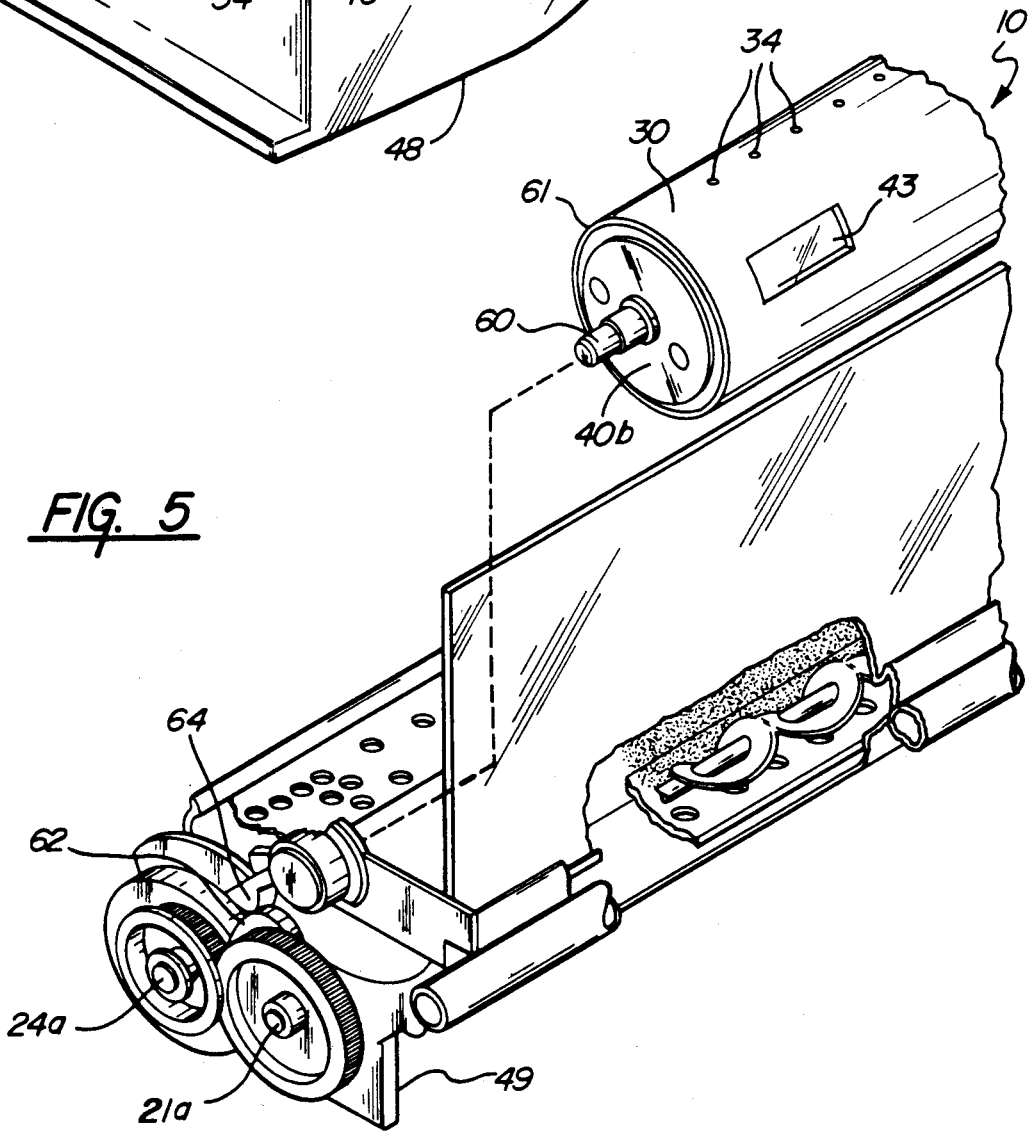
FIG. 5 is a perspective view of the end cap and support for the opposite end of the toner cartridge shown in FIG. 4.

Toner supply cartridge 30 may be fabricated of a wide variety of materials including suitable metals and thermosetting plastics. In order for the toner supply cartridge 10 to function optimally, it is desirable that the material of which it is fabricated be lightweight, easily machinable, and non-deformable at operational temperatures. In one embodiment of the instant invention, all or part of the toner supply cartridge 10 is made of a transparent or translucent material to enable the user to easily determine the level of particulate toner material 31 remaining inside cylinder 30. As depicted in FIG. 6, which is an inside cross-sectional view of the toner supply cartridge 10 shown in FIG. 3, end cap 40*a* is formed of a substantially transparent material. Hence, it is easy for the user to simply look at the end 41 of cylinder 30 to determine the level of remaining toner. Alternatively, as shown in FIG. 5, cylinder 30 itself may have disposed on the surface thereof a window 43 formed of a substantially transparent or translucent material.

In FIG. 6, the tip T of each of arms 38*c*, 38*d* engages the inner wall 35 of cylinder 30 as cylinder 30 rotates. Scoop 38 is dimensioned such that it will both roll and slide inside cylinder 30 as it rotates. In this manner, the tips T of various of the arms 38*a*, 38*b*, 38*c* and 38*d* will scrap an inner wall 35 of cylinder 30, thereby forcing toner material 31 out of ports 34. Furthermore, as cylinder 30 rotates, toner discharge ports 34 will rotate toward the bottom of cylinder 30 and will come into contact with one of the arms 38*a*, 38*b*, 38*c*, 38*d* of scoop 38. This contact will force a portion of particulate toner material through each toner discharge port 34 (and each opening 36 if stationary sleeve 32 is provided), and the discharged particulate toner material 31 will pass through mixing chamber 21 to be mixed with carrier beads. In this way, a continuous supply of developer will be provided in developer sump 20.

Doubtless, other designs and configurations of the herein invention may be gleenable from the herein disclosure and claims to one skilled in the art of xerographic toner dispensers. Such incidental variations are considered to be within the scope of the teaching of the instant invention which is defined by the following claims.

We claim:

1. A cartridge for supplying and distributing magnetically responsive dry particulate toner material to a latent electrostatic image formed on a movable surface for subsequent transfer to a copy substrate, said cartridge comprising:

a hollow cylinder for containing a supply of toner material;

means for supporting said cylinder at both ends;

drive means for rotating said cylinder in timed relation to the movable surface;

a plurality of toner discharge ports formed in said cylinder disposed at intervals thereon along a longitudinal axis thereof;

a freely riding, multi-cup scoop disposed inside the cylinder for moving the toner material and assisting in the discharge thereof through the discharge ports, said scoop extending in a longitudinal direction for substantially the length of the cylinder, and wherein the scoop is configured to have four arms extending in a radial direction and such that each of the arms terminates in a tapered end.

2. The cartridge of claim 1 wherein the multi-cup scoop is configured to have an approximate cross shaped section transverse the longitudinal direction.

3. The cartridge of claim 1 further comprising a stationary sleeve disposed around the cylinder, said sleeve having a plurality of openings formed therein at locations thereon corresponding to the locations of the toner discharge ports such that, as the cylinder rotates, the ports periodically come into alignment with the openings to permit the discharge of toner material therethrough.

4. The cartridge of claim 3 wherein the ports are substantially smaller than the openings.

5. The cartridge of claim 4 wherein the ports are circular in configuration and have a diameter of no greater than 0.06 inches.

6. The cartridge of claim 4 wherein the openings are circular in configuration and have a diameter of no greater than 0.30 inches.

7. The cartridge of claim 1 wherein the multi-cup scoop has a cross-sectional diameter in a range of between $1\frac{1}{4}$ and $1\frac{3}{8}$ inches.

8. The cartridge of claim 1 wherein at least a portion of the cylinder is formed of a translucent material.

9. The cartridge of claim 1 further comprising two opposed end caps disposed at opposite ends of the cylinder to provide an enclosure for containment of the toner material.

10. The cartridge of claim 9 wherein at least one of said opposed end caps is formed of a transparent material.

11. The cartridge of claim 9 wherein the support means includes the opposed end caps.

12. The cartridge of claim 9 wherein at least one of the end caps is formed of a translucent material.

13. The cartridge of claim 1 wherein at least a portion of the cylinder is formed of a transparent material.

* * * * *